US009802191B2

(12) United States Patent
Wright

(10) Patent No.: US 9,802,191 B2
(45) Date of Patent: Oct. 31, 2017

(54) DISPOSABLE, FLUID ACTUATED, MECHANICALLY DRIVEN POINT-OF-CARE INVITRO-DIAGNOSTIC APPARATUS AND METHOD OF PERFORMING A POINT-OF-CARE INVITRO-DIAGNOSTIC TEST

(71) Applicant: David W. Wright, Littleton, CO (US)

(72) Inventor: David W. Wright, Littleton, CO (US)

( * ) Notice: Subject to any disclaimer, the term of this patent is extended or adjusted under 35 U.S.C. 154(b) by 206 days.

(21) Appl. No.: 14/745,034

(22) Filed: Jun. 19, 2015

(65) Prior Publication Data

US 2015/0367339 A1 Dec. 24, 2015

Related U.S. Application Data

(60) Provisional application No. 62/014,383, filed on Jun. 19, 2014.

(51) Int. Cl.
*B01L 3/00* (2006.01)

(52) U.S. Cl.
CPC ..... *B01L 3/50273* (2013.01); *B01L 2200/16* (2013.01); *B01L 2300/0816* (2013.01); *B01L 2300/0867* (2013.01); *B01L 2300/123* (2013.01); *B01L 2400/0481* (2013.01); *B01L 2400/0672* (2013.01); *B01L 2400/0683* (2013.01)

(58) Field of Classification Search
CPC ... G01N 2035/00544; B01L 2400/0481; B01L 2400/0683; B01L 2300/0816; B01L 2300/123; B01L 3/50273; B01L 3/505; B01L 2200/0621; B01L 2400/0672; B01L 2400/084; B01L 3/502; B01L 7/52; B01F 11/0045
See application file for complete search history.

(56) References Cited

FOREIGN PATENT DOCUMENTS

WO WO 2013/165420 * 11/2013 ..... G01N 33/49

* cited by examiner

*Primary Examiner* — Sally Merkling
(74) *Attorney, Agent, or Firm* — John D. Wright; Dickinson Wright PLLC

(57) ABSTRACT

A portable, disposable in-vitro diagnostic apparatus and method of performing a point-of-care invitro-diagnostic test is provided. The apparatus has a body with at least one chamber containing an actuator member. The chamber is in fluid communication with an upstream first fluid channel and a downstream second fluid channel. The actuator member has a compressed, deactivated state and an expanded, activated state. The actuator member transitions from the compressed, deactivated state to the expanded, activated state upon contact with fluid flowing through the first fluid channel. The actuator member pumps fluid outwardly from the first chamber through the second fluid channel during the transition from its compressed, deactivated state to its expanded, activated state. The pumped fluid can be channeled to other chambers within the body and/or to an analysis chamber within the body for study.

12 Claims, 6 Drawing Sheets

FIG. 7
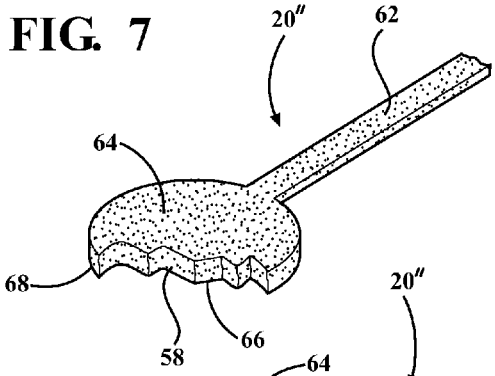
FIG. 8
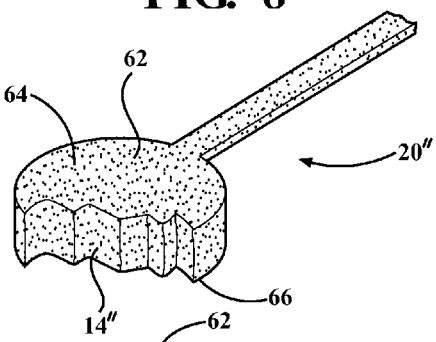
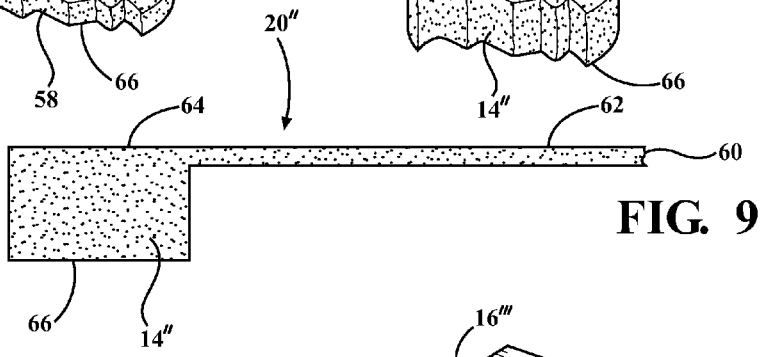
FIG. 9
FIG. 10
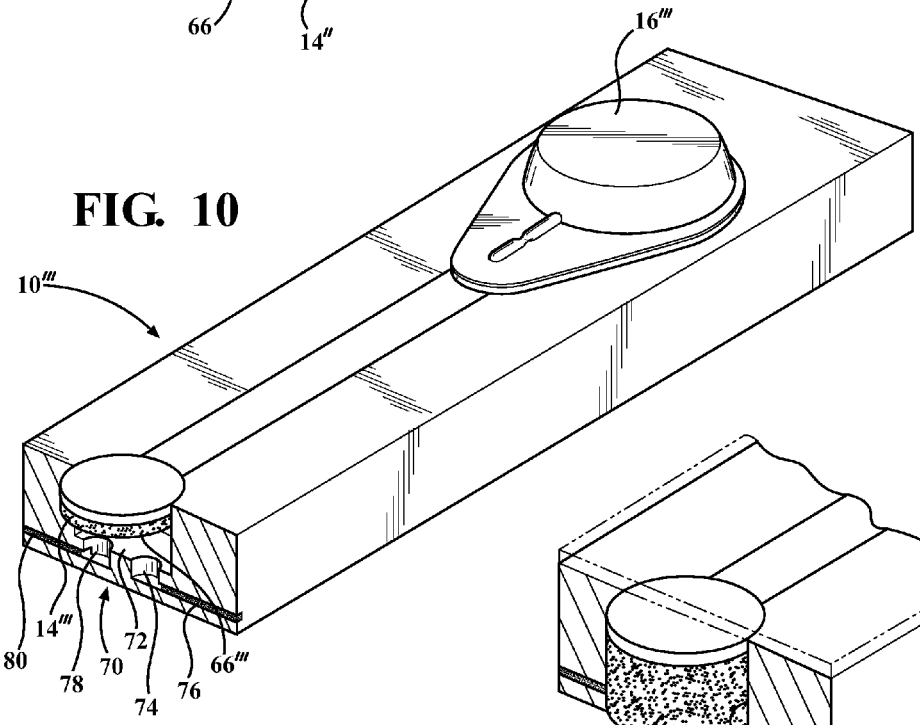
FIG. 11
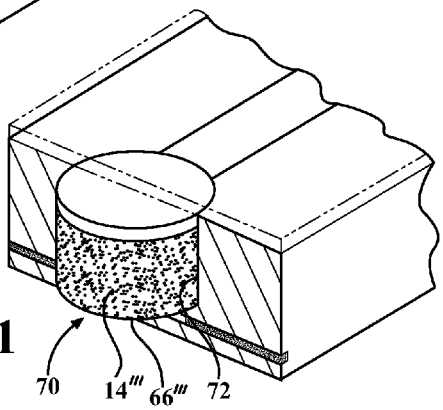

DISPOSABLE, FLUID ACTUATED, MECHANICALLY DRIVEN POINT-OF-CARE INVITRO-DIAGNOSTIC APPARATUS AND METHOD OF PERFORMING A POINT-OF-CARE INVITRO-DIAGNOSTIC TEST

CROSS-REFERENCE TO RELATED APPLICATION

This application claims the benefit of U.S. Provisional Application Ser. No. 62/014,383, filed Jun. 19, 2014, which is incorporated herein by reference in its entirety.

BACKGROUND

1. Technical Field

This invention relates generally to in-vitro diagnostics, and more particularly to disposable, point-of-care invitro-diagnostic apparatus and methods for performing point-of-care invitro-diagnostic tests.

2. Related Art

Biological diagnostic tests are a fundamental component in the process of determining the state or condition of a biological environment. Biological environments include, but are not limited to, human healthcare, agriculture, livestock management, municipal system management, and national defense. A new diagnostic market is emerging at the point-of-care. Currently, diagnostic tests utilize complex diagnostic devices. Such complex devices typically require a companion durable hardware device that interfaces with the device to execute the test. Such hardware devices are expensive, relatively large, and require an external source of power to operate.

SUMMARY OF THE INVENTION

A portable, disposable, low-cost invitro-diagnostic apparatus is provided in accordance with one aspect of the invention. The apparatus is economical in manufacture and in use, as it provides a quick, reliable and economical apparatus and method for precisely timed collapsing of a blister or series of blisters throughout an in-vitro diagnostic test on a selected specimen. Further, the apparatus provides sequential mechanical action over a predetermined time to allow a desired analysis of the specimen contained within the apparatus without need of a durable hardware device or other secondary apparatus, or external source of power.

In accordance with another aspect of the invention, the apparatus automatically channels and drives fluid throughout the device in timely, orderly fashion by an internal mechanical driver. The mechanical driver, referred to as expandable actuator member, automatically depresses one or more blisters within sequentially arranged blisters, opens and/or closes valves, and can perform other mechanical tasks, upon the device being initially selectively actuated.

In accordance with another aspect of the invention, the apparatus may be self-contained or operable to interface with an exterior apparatus to initiate or control the sequence of action producing a diagnostic result or to simple prepare a sample for analysis.

A portable, disposable in-vitro diagnostic apparatus constructed in accordance with one aspect of the invention includes a body having at least one chamber. A first fluid channel is formed in the body. An actuator member is contained in a first chamber of the at least one chamber, wherein the actuator is located downstream from, and in fluid communication with, the first fluid channel. A second fluid channel is formed in the body. The second fluid channel is located downstream from, and in fluid communication with, the first chamber. The actuator member has a compressed, deactivated state and an expanded, activated state. The actuator member is configured to transition from the compressed, deactivated state to the expanded, activated state upon contact with fluid flowing through the first fluid channel. The actuator member pumps fluid outwardly from the first chamber through the second fluid channel during the transition from its compressed, deactivated state to its expanded, activated state. The pumped fluid can be channeled to other chambers within the body and/or to an analysis chamber within the body for study.

In accordance with a further aspect of the invention, the portable, disposable in-vitro diagnostic apparatus can include a sealed primary blister containing a sealed fluid upstream from, and in fluid communication with, the first fluid channel, with the sealed primary blister being rupturable to allow the sealed fluid to flow through the first fluid channel into contact with the actuator member.

In accordance with a further aspect of the invention, the portable, disposable in-vitro diagnostic apparatus can include a wicking element in the first channel, with the wicking element causing fluid to flow through the first channel into contact with the actuator member.

In accordance with a further aspect of the invention, the portable, disposable in-vitro diagnostic apparatus, the wicking element and the actuator member can be formed as a single, monolithic piece of the same material.

In accordance with a further aspect of the invention, a fluid impervious layer can be formed to cover the wicking element and the actuator member.

In accordance with a further aspect of the invention, the portable, disposable in-vitro diagnostic apparatus can include a sealed secondary blister contained in the first chamber adjacent the actuator member, with the sealed secondary blister containing a reagent fluid and being rupturable under a force applied by the actuator member while transitioning from the compressed, deactivated state to the expanded, activated state to allow the reagent fluid to flow through the second fluid channel.

In accordance with a further aspect of the invention, the portable, disposable in-vitro diagnostic apparatus can include an analysis chamber in fluid communication with the second fluid channel downstream from the first chamber, with a clear cover sealing off the analysis chamber to allow viewing of a specimen contained in the analysis chamber.

In accordance with a further aspect of the invention, the portable, disposable in-vitro diagnostic apparatus can include a lid covering the first chamber, with the lid being configured to move between an open position to allow a specimen to be disposed in the first chamber and a closed position to seal the specimen in the first chamber.

In accordance with a further aspect of the invention, the portable, disposable in-vitro diagnostic apparatus can include an inlet channel extending through the body into fluid communication with the first chamber via an inlet port.

In accordance with a further aspect of the invention, the portable, disposable in-vitro diagnostic apparatus can include an outlet channel extending through the body into fluid communication with the first chamber via an outlet port.

In accordance with a further aspect of the invention, a method of performing a point-of-care invitro diagnostic test is provided. The method includes: disposing a specimen to be analyzed in a disposable diagnostic apparatus; channeling fluid through a first channel into a first chamber and causing an actuator member to expand upon contact with the fluid from a compressed, deactivated state to an expanded, activated state, thereby causing a fluid to be pumped outwardly from the first chamber under bias of the actuator to a second chamber for analysis.

In accordance with a further aspect of the invention, the method can further include rupturing a primary blister upstream from the first chamber to cause the fluid to flow through the first fluid channel into the first chamber.

In accordance with a further aspect of the invention, the method can further include wicking the fluid through the first channel into the first chamber.

In accordance with a further aspect of the invention, the method can further include rupturing a sealed secondary blister containing a reagent fluid under a force applied by the actuator member while transitioning from the compressed, deactivated state to the expanded, activated state and channeling the reagent fluid to the second chamber for analysis.

In accordance with a further aspect of the invention, the method can further include disposing a specimen in the first chamber and pumping the specimen under a force applied by the actuator member while transitioning from the compressed, deactivated state to the expanded, activated state to the second chamber for analysis.

In accordance with a further aspect of the invention, the method can further include introducing a fluid into the first chamber through an inlet port prior to channeling the fluid through the first channel.

In accordance with a further aspect of the invention, the method can further include maintaining the actuator member in the compressed, deactivated state with a fluid dissolvable binder.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

FIG. 7 illustrates a wicking member and expandable actuator member in accordance with another aspect of the invention shown in a compressed state, wherein the wicking member and expandable member are formed as one monolithic piece of material encapsulated in a fluid impervious outer layer or skin;

FIG. 8 illustrates the wicking member and expandable actuator member of FIG. 7 with the expandable actuator member shown in an activated, expanded state;

FIG. 9 is a cross-sectional side view of the wicking member and expandable actuator member of FIG. 8 with a fluid introduction port located at one end of the wicking member and the expandable actuator member located at an opposite end of the wicking member;

FIG. 10 illustrates a fragmentary perspective cross-sectional view of a disposable, fluid actuated, mechanically driven diagnostic apparatus in accordance with another aspect of the invention, with the apparatus having a valve mechanism being in operable fluid communication with an expandable actuator member, wherein the valve mechanism has an inlet and an outlet shown in an open state with the expandable actuator member being operable to close the valve mechanism upon activated expansion of the expandable actuator member;

FIG. 11 illustrates a perspective cross-sectional view of the valve mechanism of FIG. 10 in a closed state;

DETAILED DESCRIPTION OF PRESENTLY PREFERRED EMBODIMENTS

Figure 1:
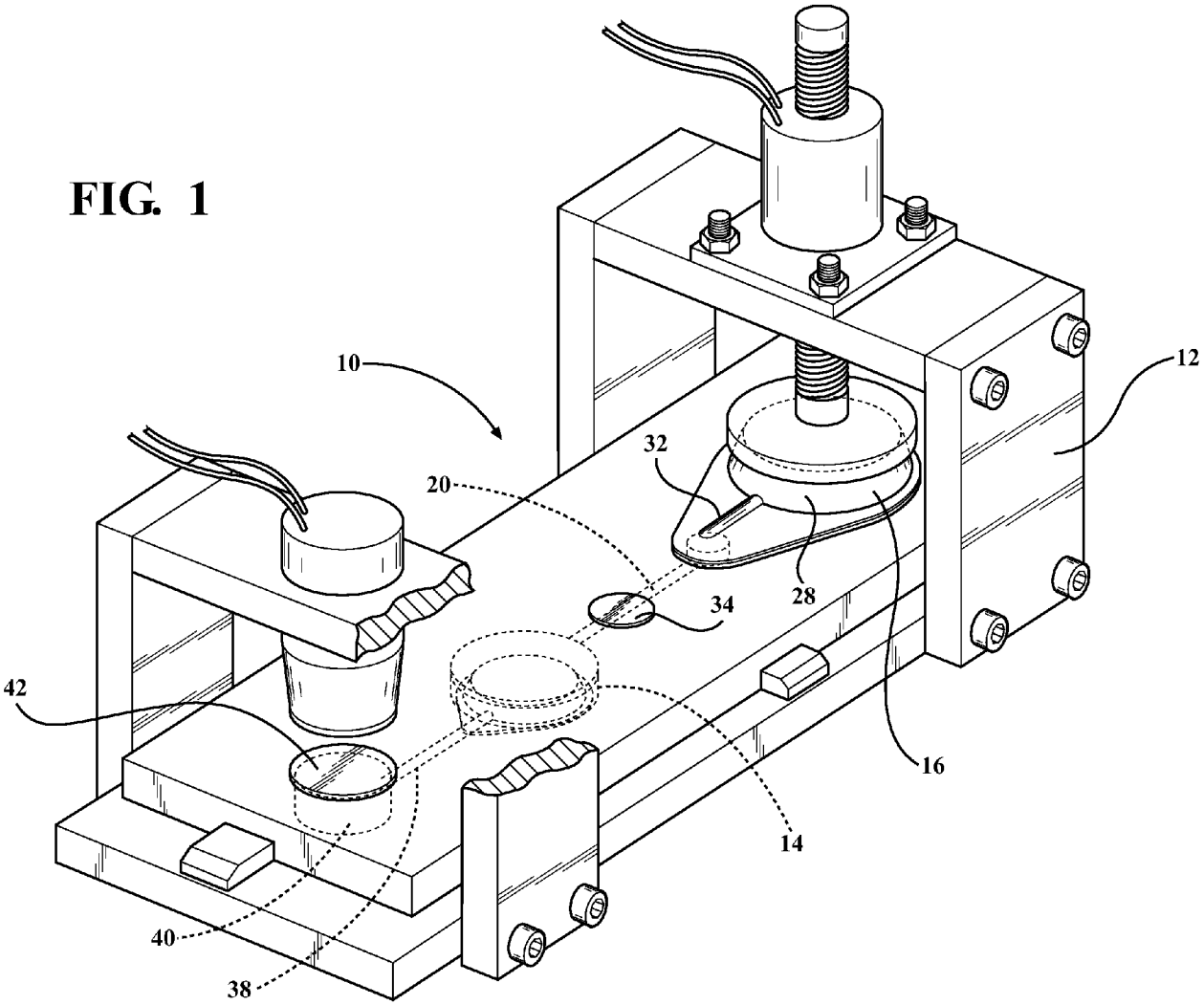
FIG. 1 is a perspective view of a disposable, fluid actuated, mechanically driven diagnostic apparatus constructed in accordance with one embodiment of the invention shown in an actuation and analysis device.

Referring in more detail to the drawings, FIG. 1 illustrates a portable, disposable in-vitro diagnostic apparatus 10 constructed in accordance with one aspect of the invention located on an actuation and analysis device 12. The apparatus 10 has a body 11 supporting and/or containing an expandable actuator member 14 in a chamber 15, a primary blister 16 containing a fluid 18 configured for operable fluid communication with a wicking member or element 20 contained in a flow channel 22, with the wicking member 20 providing operable fluid communication between the primary blister 16 and the expandable actuator member 14. Upon selectively rupturing and actuating the primary blister 16, the fluid 18 initially contained within the blister 16 flows through the flow channel 22 via the wicking element 20 and is received by the initially compressed, expandable actuator member 14. Upon the expandable actuator member 14 contacting the fluid 18, in accordance with one aspect of the invention, a binding agent within the compressed expandable actuator member 14 is dissolved by the fluid 18, thereby causing the initially compressed, expandable actuator member 14 to expand, thereby releasing the stored mechanical potential energy within the initially compressed, expandable actuator member 14. The expanding actuator member 14 causes a secondary blister 24 containing a reagent 26 to be depressed and mechanically actuated. Alternatively, the expandable actuator member 14 can include a hygroscopic material that absorbs the fluid 18 operably channeled from the blister 16 or otherwise, wherein the expandable actuator member 14 expands while absorbing the fluid 18 to produce the same resulting mechanical kinetic energy, thereby causing the secondary blister 24 to be at least partially crushed and actuated.

Figure 2:
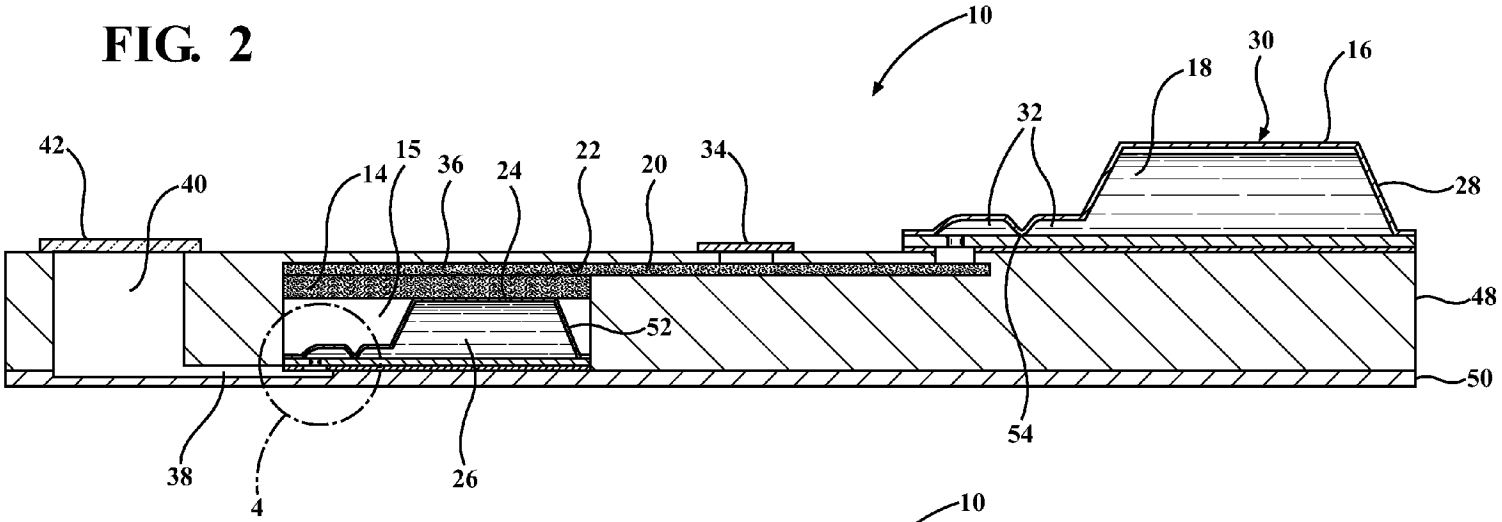
FIG. 2 is a cross-sectional view of the apparatus of FIG. 1, with the apparatus shown in a first, deactivated state.
Figure 3:
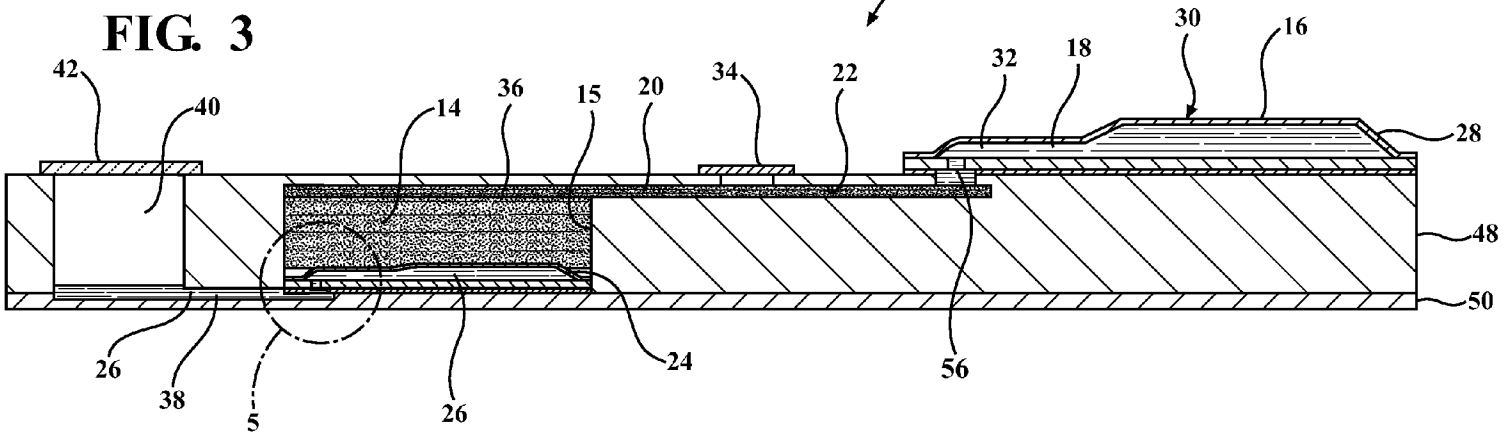
FIG. 3 is a view similar to FIG. 2 showing the apparatus in an activated state.

Referring in more detail to FIGS. 2 and 3, the primary blister 16 has a side wall 28 that is depressed and collapsed (FIG. 3) by pushing on a top surface 30 of the primary blister 16, thus forcing the fluid 18 contained within the primary blister 16 through a delivery channel 32 of the primary blister 16 and into the channel 22 containing the wicking element 20. The fluid 18 flows via the wicking element 20 past an air eliminating, expulsion vent 34, along the fluid wick path channel 22 into an actuator wick pad 36, located adjacent the expandable actuator member 14, thereby bring the expandable actuator member 14 into contact with the fluid 41 to wet the actuator member 14, thereby, resulting in simultaneous expansion of the actuator member 14 and depressing and actuation of the underlying reagent containing secondary blister 24, also referred to as reagent blister 24. The effluent 26 from the reagent blister 24 is then exhausted or expelled from the reagent blister 24 through a downstream channel 38, such as to a specimen chamber 40, whereupon the mixture within the specimen chamber 40 can be viewed and analyzed via the actuator and analysis device 12 through a clear cover 42.

Figure 6:
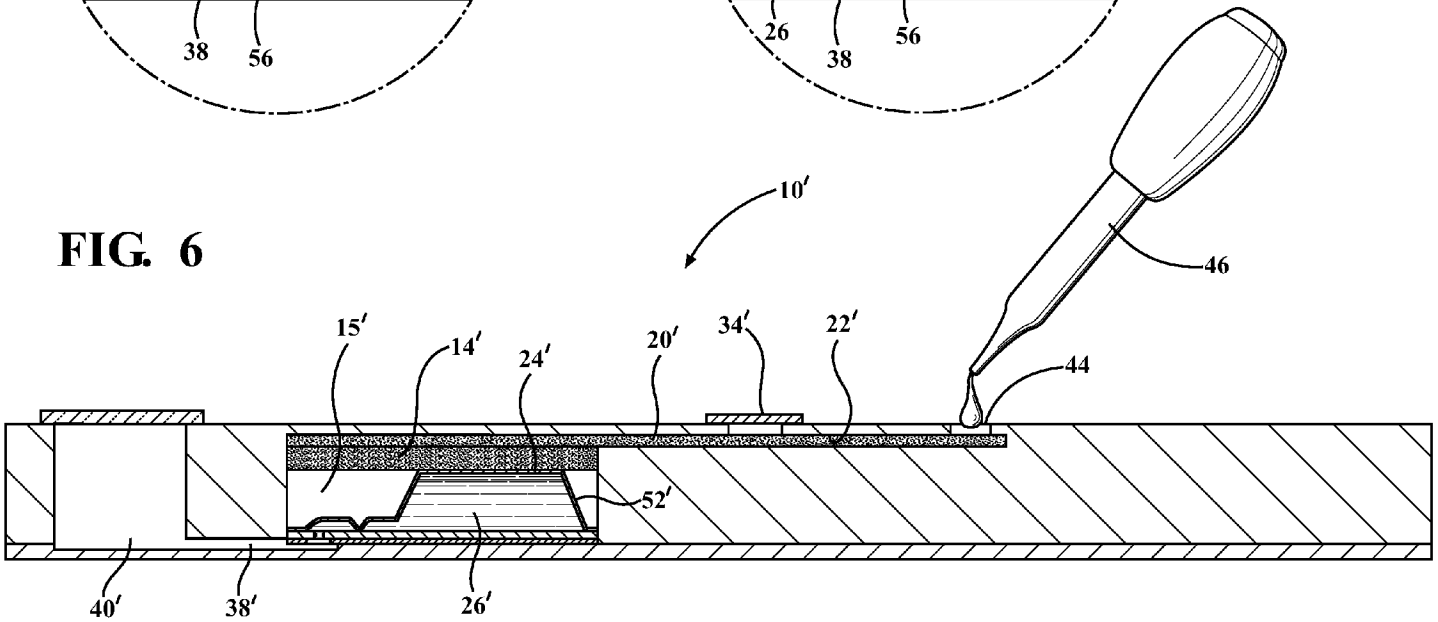
FIG. 6 is a view similar to FIG. 2 illustrating an apparatus constructed in accordance with another embodiment of the invention which provides an alternative method of introducing fluid to the wicking member via use of an external fluid delivery apparatus.

Another embodiment of a portable, disposable in-vitro diagnostic apparatus 10' constructed in accordance with another aspect of the invention is illustrated in FIG. 6, wherein the same reference numerals, primed, are used to identify like features discussed above for the apparatus 10. The apparatus 10' allows for fluid 18 to be added to a fluid entrance port 44 by use of an externally supplied fluid delivery apparatus 66, such as a pipet or fluid dropper, thus eliminating the need for a primary blister. The expandable actuator member 14' is depicted in a compressed state in FIG. 6. Fluid 18 is introduced into the fluid entrance port 44 and travels through the wicking element 20', past the air vent 34', whereupon the fluid 18 comes into contact with the expandable actuator member 14' along the channel 22'.

The expandable actuator member 14, 14' is comprised of, by way of example and without limitation, an open cell foam, thus allowing fluid to propagate through the open cellular structure of the foam. The open cell foam may be hydrophilic, promoting the propagation of fluid throughout the apparatus, or it may be hydrophobic, thus requiring a secondary element to promote absorption of fluid. The open cell foam is elastically compressible and can be doped with a binding agent that releasably holds the open cell foam in its initially compressed configuration upon drying or curing the binding agent. The binding agent dissolves upon exposure to the wicked fluid 18 from the blister 16 or from the fluid dispensing apparatus 46, depending on the embodiment used, thus releasing the stored potential energy and causing the open cell foam of the expandable actuator member 14, 14' to expand and exert mechanical energy on the adjacent secondary blister 24, 24', thereby causing the effluent 26, 26' to be pumped outwardly from the secondary blister 24, 24'. The rate of expansion of the expandable actuator member 14, 14' is a function of the dissolution rate of the binder and/or the rate of delivery of the fluid 18 dissolving the binding agent. The binding agent may be a water-soluble glue or other such dissolvable binder, by way of example and without limitation.

Another embodiment of the invention includes open cell foam that retains its initially compressed shape without a binding agent, but contains hygroscopic properties, thus expanding upon contact with fluid.

A housing for the apparatus 10, 10' is comprised of, by way of example and without limitation, a top housing 48 and a bottom housing 50 fixed to one another. Cavities can be formed in the top housing 48 and/or the bottom housing 50 to provide the features discussed herein. As such, it should be recognized that any number of components, including one or more, can be fixed together to form the housing of the apparatus 10, 10'.

The expandable actuator member 14, 14' is decompressed automatically upon dissolving the binding agent in the fluid 18, thereby causing expansion of the expandable actuator member 14, 14' which in turn exerts a force against reagent blister 24, 24' and collapses a sidewall 52, 52' of the reagent blister 24, 24', thereby expelling the reagent fluid 26 through the downstream fluidic channel 38, 38' and into the specimen chamber 40, 40'.

Figure 5:
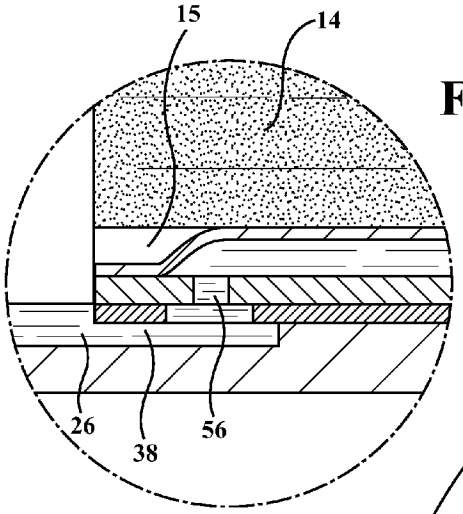
FIG. 5 is an enlarged view of the encircled area 5 of FIG. 3.
Figure 4:
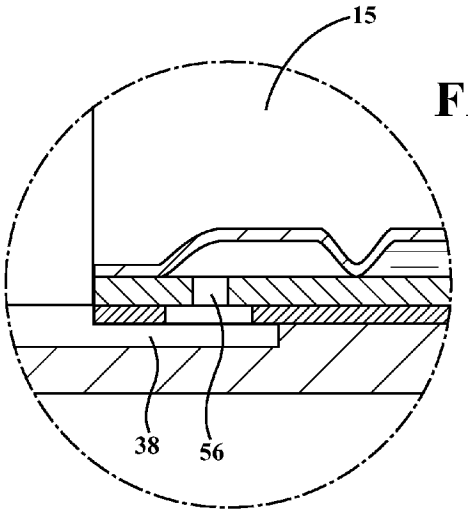
FIG. 4 is an enlarged view of the encircled area 4 of FIG. 2.

One embodiment constructed in accordance with the invention includes a delaminatable or peelable seal 54 on or adjacent the blisters 16, 24, 24', as depicted best in enlarged FIG. 4. The delaminatable or peelable seal 54 is opened, as best shown in enlarged FIG. 5 under the pressure exerted by the respective fluids 18, 26, thus forcing the fluids 18, 26 through respective outlets 56 of the blisters 16, 24, 24', thereby allowing the fluids 18, 26 to flow through their respective downstream channels 22, 38. Other blisters are contemplated herein, such as those disclosed in pending U.S. patent application Ser. No. 14/609,259, which is incorporated herein by reference in its entirety.

One embodiment of the invention includes an integral wicking element 20" with an expandable actuator member 14", as shown in FIGS. 7-9. In the compressed state, the open cell foam with dissolvable binder 58 is under tension. Fluid 18 is introduced through an inlet 60 of the wicking element 20" and is wicked along the open cell foam contained within a fluid impervious outer sealed skin 62 of the wicking element 20" and the fluid 18 accumulates within the compressed open cell foam contained within the volume defined by the upper sealed expandable actuator surface 64, a lower sealed expandable actuator surface 66 and a collapsed or compressed side wall 68, whereupon the collapsed side wall 68 is forced to expand under the pressure of the expanding open cell foam to take on an expanded configuration as the binder or hydroscopic material is dissolved by the fluid 18.

A portable, disposable in-vitro diagnostic apparatus 10''' constructed in accordance with another aspect of the invention is partially illustrated in in FIGS. 10 and 11. The apparatus 10''' utilizes an expandable actuator member 14''', such as discussed above with regard to the integral wicking element 20" with an expandable actuator member 14" shown in FIGS. 7-9, by way of example and without limitation, to actuate u valve 70. It is not necessary that the expandable actuator member 14''' be integral with a wicking element; however, it is important that a lower surface 66''' of the expandable actuator member 14''' be impermeable to fluid for reasons discussed below. The valve 70 includes of a valve chamber 72 and at least one, and shown as a plurality of two valve ports 74, 78, which can be configured to receive and/or dispel fluid through corresponding channels 76, 80. In one application, valve port 74 serves as an inlet port to allow fluid to flow through channel 76 into the chamber 72, while valve port 78 serves as an outlet port to allow fluid to flow through channel 80 outward from the chamber 72. However, it should be recognized that he both channels 76, 80 can serve to introduce fluid into the chamber 72, if desired, depending the intended application. While fluid is being introduced into the chamber 72 via either of the ports 76, 80, the fluid does not activate the expandable actuator member 14''' as a result of the lower surface 66''' being fluid impermeable, and thus, the expandable actuator member 14''' remains deactivated and compressed until it is selectively expanded via fluid coming into contact with the expandable foam or material of the actuator member 14''' from an upstream fluid source, such as from an upstream fluid containing blister 16''', by way of example and without limitation. Upon receiving fluid from the upstream fluid source 16''', the compressed open cell foam expands, thereby occluding the valve port 74 and the valve port 78 and pumping the fluid within the chamber 72 downstream to a further chamber(s), such as discussed with regard to apparatus 10.

Figure 12:
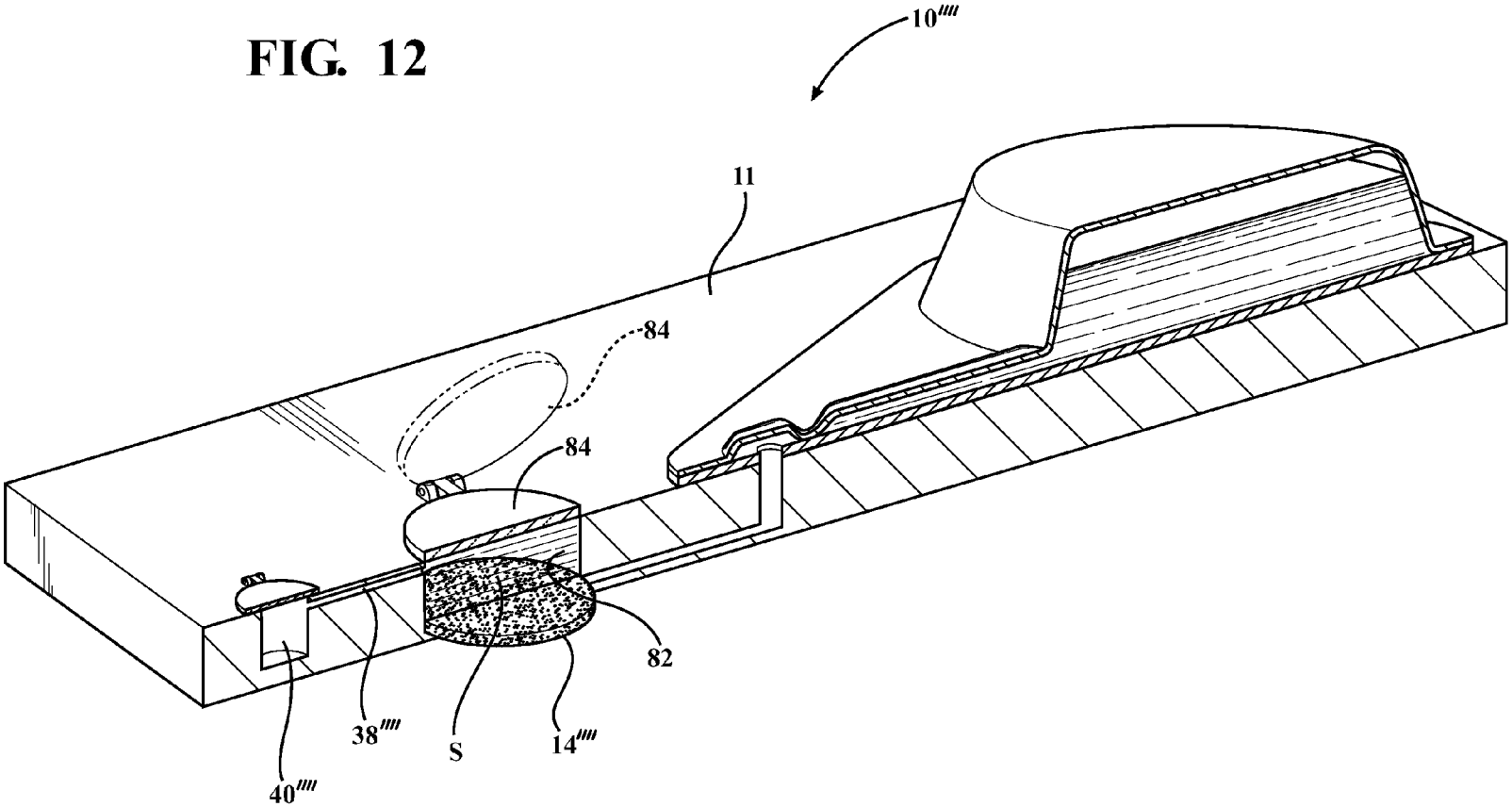
FIG. 12 is a perspective cross-sectional view of an apparatus constructed in accordance with another embodiment of the invention, with the apparatus having a primary pumping member or blister and an expandable actuator member, shown in an deactivated, compressed state, wherein the primary pumping member is employed to pump a fluid sample from a sample chamber to another region within or outside of the apparatus.
Figure 13:
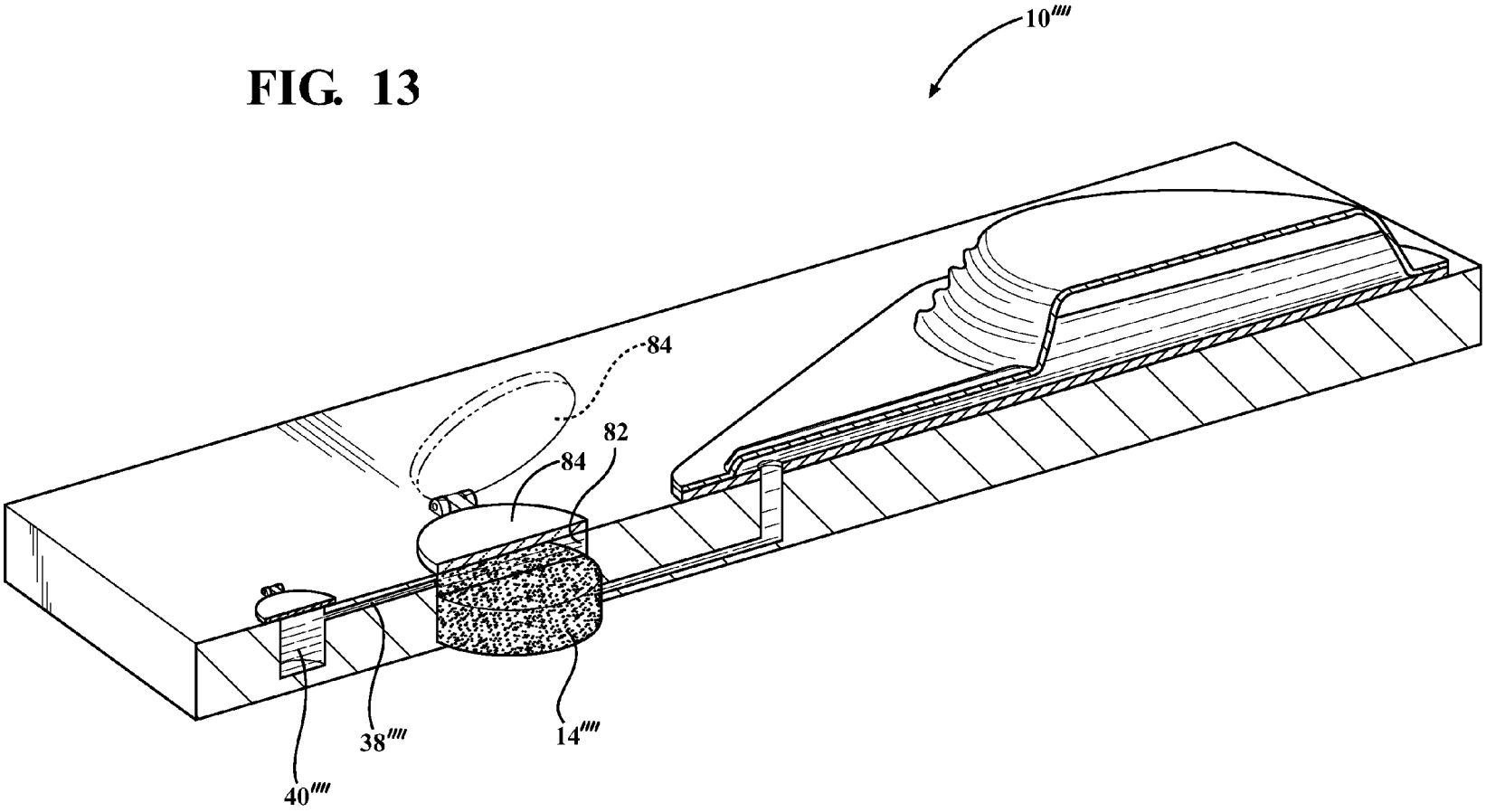
FIG. 13 is a view similar to FIG. 12 with the expandable actuator member shown in an activated, expanded state.

An apparatus 10'''' in accordance with another aspect of the invention, as shown in FIGS. 12 and 13, utilizes an expandable actuator member 14'''' to expand the open cell foam from a compressed, closed state (FIG. 12) to an open, expanded state (FIG. 13) to pump or motivate a fluid sample S from a sample chamber 82 through a downstream fluid channel 38'''' to a specimen sample viewing and analysis chamber 40''''. The sample S is placed into the sample chamber 82 and a sample chamber lid 84 is closed to form a liquid tight seal. It should be recognized that features shown in FIGS. 12 and 13 are similar to those discussed above, and thus, one skilled in the art will readily appreciate their function without further, repetitive description.

Obviously, many modifications and variations of the present invention are possible in light of the above teachings. It is, therefore, to be understood that within the scope of the appended claims, the invention may be practiced otherwise than as specifically described.

What is claimed is:

1. A portable, disposable in-vitro diagnostic apparatus, comprising:

a body having at least one chamber;

a first fluid channel in said body;

an actuator member contained in a first chamber of said at least one chamber, said actuator being downstream from, and in fluid communication with, said first fluid channel;

a second fluid channel in said body, said second fluid channel being downstream from, and in fluid communication with, said first chamber; and said actuator member having a compressed, deactivated state and an expanded, activated state, said actuator member being configured to transition from said compressed, deactivated state to said expanded, activated state upon contact with fluid flowing through said first fluid channel, said actuator member being configured to pump fluid outwardly from said first chamber through said second fluid channel during said transition from said compressed, deactivated state to said expanded, activated state.

2. The portable, disposable in-vitro diagnostic apparatus of claim 1 further including a sealed primary blister containing a sealed fluid upstream from, and in fluid communication with, said first fluid channel, said sealed primary blister being rupturable to allow said sealed fluid to flow through said first fluid channel into contact with said actuator member.

3. The portable, disposable in-vitro diagnostic apparatus of claim 1 further including a wicking element in said first channel, said wicking element causing fluid to flow through said first channel into contact with said actuator member.

4. The portable, disposable in-vitro diagnostic apparatus of claim 3 wherein said wicking element and said actuator member are a single piece of common material.

5. The portable, disposable in-vitro diagnostic apparatus of claim 4 further including a fluid impervious layer covering said wicking element and said actuator member.

6. The portable, disposable in-vitro diagnostic apparatus of claim 1 further including a sealed secondary blister contained in said first chamber adjacent said actuator member, said sealed secondary blister containing a reagent fluid and being rupturable under a force applied by said actuator member while transitioning from said compressed, deactivated state to said expanded, activated state to allow said reagent fluid to flow through said second fluid channel.

7. The portable, disposable in-vitro diagnostic apparatus of claim 1 further including an analysis chamber in fluid communication with said second fluid channel downstream from said first chamber, a clear cover sealing off said analysis chamber to allow viewing of a specimen contained in said analysis chamber.

8. The portable, disposable in-vitro diagnostic apparatus of claim 1 further including a lid covering said first chamber, said lid being configured to move between an open position to allow a specimen to be disposed in said first chamber and a closed position to seal the specimen in said first chamber.

9. The portable, disposable in-vitro diagnostic apparatus of claim 1 further including an inlet channel extending through said body into fluid communication with said first chamber via an inlet port.

10. The portable, disposable in-vitro diagnostic apparatus of claim 9 further including an outlet channel extending through said body into fluid communication with said first chamber via an outlet port.

11. The portable, disposable in-vitro diagnostic apparatus of claim 10 wherein said actuator member seals off said inlet port and said outlet port when in said expanded, activated state.

12. The portable, disposable in-vitro diagnostic apparatus of claim 1 further including a fluid dissolvable binder maintaining said actuator member in said compressed, deactivated state.

* * * * *